US006860189B2

(12) United States Patent
Perez

(10) Patent No.: US 6,860,189 B2
(45) Date of Patent: Mar. 1, 2005

(54) ROTARY ACTUATOR WITH CARTRIDGE AND CHAIN OR CABLE

(75) Inventor: Jose Perez, Vancouver (CA)

(73) Assignee: HiFlex Technologies Inc., Vancouver (CA)

( * ) Notice: Subject to any disclaimer, the term of this patent is extended or adjusted under 35 U.S.C. 154(b) by 0 days.

(21) Appl. No.: 10/473,806

(22) PCT Filed: Apr. 5, 2002

(86) PCT No.: PCT/CA02/00493

§ 371 (c)(1),
(2), (4) Date: Oct. 2, 2003

(87) PCT Pub. No.: WO02/081931

PCT Pub. Date: Oct. 17, 2002

(65) Prior Publication Data

US 2004/0129132 A1 Jul. 8, 2004

(30) Foreign Application Priority Data

Apr. 6, 2001 (CA) ..... 2343480

(51) Int. Cl.[7] ..... F01B 19/04
(52) U.S. Cl. ..... 92/92; 92/137
(58) Field of Search ..... 92/90, 91, 92, 92/137; 74/89.2

(56) References Cited

U.S. PATENT DOCUMENTS

| | | | |
|---|---|---|---|
| 3,267,817 | A | 8/1966 | Adams |
| 3,739,663 | A | 6/1973 | Wilms |
| 4,006,669 | A | 2/1977 | Price |
| 4,008,008 | A | 2/1977 | Vergnet |
| 4,108,050 | A | 8/1978 | Paynter |
| 4,225,110 | A | 9/1980 | Akkerman et al. |
| 4,615,260 | A | 10/1986 | Takagi et al. |
| 4,777,868 | A | 10/1988 | Larsson |
| 4,833,973 | A | 5/1989 | Wang |
| 4,841,845 | A | 6/1989 | Beullens |
| 4,860,639 | A | 8/1989 | Sakaguchi |
| 5,067,390 | A | 11/1991 | Negishi |
| 5,158,005 | A | 10/1992 | Negishi et al. |
| 5,201,262 | A | 4/1993 | Negishi et al. |
| 6,000,675 | A | 12/1999 | Eggleston |
| 6,209,443 | B1 | 4/2001 | Perez |

FOREIGN PATENT DOCUMENTS

| | | |
|---|---|---|
| FR | 2417009 | 9/1979 |
| JP | 61153007 | 7/1986 |
| WO | WO 00/03144 | 1/2000 |

*Primary Examiner*—F. Daniel Lopez
*Assistant Examiner*—Michael Leslie
(74) *Attorney, Agent, or Firm*—Oyen Wiggs Green & Mutala

(57) ABSTRACT

An actuator which comprises a pair of elongated elastomer tubes (6,16), sealed by respective members (18, 20, 22, 24) at each end, the members at the one end (18, 20) being fixed and the members at the opposite end (22, 24) sliding in guides (34, 36), the sliding ends of the first and second tubes being connected by a chain (26) and sprocket (10) to convert linear motion to rotary motion.

10 Claims, 7 Drawing Sheets

ROTARY ACTUATOR WITH CARTRIDGE AND CHAIN OR CABLE

TECHNICAL FIELD OF THE INVENTION

This invention relates to a novel chain and cartridge actuator. More particularly, this invention pertains to a novel low pressure pneumatic or hydraulic chain and cartridge actuator which creates a rotational mechanical force to move components, machinery or control valves. When combined with a motor and operated in reverse, the actuator can be used as a compressor or pump.

BACKGROUND OF THE INVENTION

Mechanical actuators with pistons are widely used in industry for moving parts or components of machinery to carry out various functions. Actuators are used in assembly lines or industrial processes to control valves, or to operate equipment. Actuators usually operate using pneumatic or low pressure hydraulic fluid to create a force, linear or rotary, to move a component or piece of machinery.

Pneumatic pistons or actuators are of two basic types:

A. Bellows or Diaphragm. These typically are hollow and consist of preformed rubber which extends and contracts in a linear manner by an "accordion" mechanism extending or collapsing the elastomer. To avoid radial bulging, the rubber must be very heavy, horizontal movement must be very short in relation to the radial dimension of the accordion shape, and pneumatic pressure must be sufficiently low so as not to rupture the rubber. Bellows type pistons are useful primarily for short thrust, low pressure movements such as switch or brake activation. Typical maximum working pressures of bellows type pistons are limited to about 20 psig.

B. Solid tube pistons. These actuators typically comprise a solid piston sliding within a hollow solid (usually metal) tube. Solid tube pistons typically operate at working pressures in the range of about 80 psig. To contain the required pneumatic force on the piston, one or more rubber air seals enclose the circumference of the piston and thereby contain the air. The air seals are similar to piston rings in an internal combustion engine. Typically, since the piston moves along the axis of the interior of the tubular cylinder, a linear force is generated. The term "actuator" is often applied in situations where a rotary (torque) force is to be generated. In the case of mechanical actuators, the rotational force is usually obtained by utilizing a rack and pinion arrangement within the cylinder. The rack is attached to the piston and the pinion exits the cylinder radially. This requires a seal (an O-ring, for example) to contain the air pressure. Various types of actuators are available, for example, double action and spring return.

The sliding piston in a fixed cylinder actuator is commonly used for applications such as valve stem rotation. The inherent problem with this type is that they are expensive to manufacture and have wear and friction problems associated with the necessity for sliding seals on the pistons. Contaminated air can significantly shorten the life of the seals, and the design of such actuators does not permit economical serviceability. Some applications therefore require the air to be filtered or otherwise treated to prolong actuator service life.

Other linear movement mechanisms exist which comprise a tube that stretches in a linear manner, such as for air ducting used in ventilation systems. These stretchable tubular mechanisms include plastic tubing with embedded coiled wire which allows horizontal stretch of the tubing. The coiled wire provides radial strength. There is an inherent problem with such tubes. When a high pneumatic pressure is applied to the tube, it tends to turn and cause localized bulging. Such tubes with internal or embedded coils are thus suitable only for very low pressure applications.

Various inventors have attempted to solve the problems inherent in the designs of these two types of actuators by using a sealed rubber tube (air bag) and restraining its radial expansion by various means other than a bellows. These systems generally involve surrounding the rubber tube with an outer tube having helical wires. This allows the outside tube to stretch without bulging. Another method utilizes a second outside tube with compensating pneumatic pressure. These systems generally shorten the available stroke of the actuator relative to its length and also set up counteracting forces which significantly decrease the mechanical efficiency of the expanding inner tube.

A number of patents have issued or been applied to increase the pressure holding capabilities of bellows type pistons for use in actuation:

Beullens—U.S. Pat. No. 4,841,845

Negishi—U.S. Pat. No. 5,201,262

Negishi—U.S. Pat. No. 5,158,005

Negishi—U.S. Pat. No. 5,067,390

Sakaguchi—U.S. Pat. No. 4,860,639

Takagi—U.S. Pat. No. 4,615,260

Wang—U.S. Pat. No. 4,833,973

Paynter—U.S. Pat. No. 4,108,050

Vergenet—U.S. Pat. No. 4,008,008

Larsson—U.S. Pat. No. 4,777,868

Price—U.S. Pat. No. 4,006,669

Perez—WO 00/03144

Perez, PCT application No. PCT/CA99/00616, filed 7 Jul. 1999 and published under WO 00/03144, 20 Jan. 2000, uses a tube made of a strong collapsible tubular fabric or similar material, in combination with an internal sealing device, such as an inner tube. The combination radially contains the pressure exerted by a fluid pumped into the interior of the combination, with the result that the fluid pressure is translated to a linear force exerted along the axis of the tube.

Eggleston—U.S. Pat. No. 6,000,675

Eggleston discloses a rotary valve actuator with movable actuator linkage maintained in a constant "pull-pull" tension. It includes a sliding canister, rotatable lever, a rolling diaphragm bladder and a return spring substantially aligned with each other. The linear motion of the canister in response to an expanding and contracting pressurized bladder is converted through chain linkage into rotary lever motion. The return spring is connected through respective chain linkage to the rotatable lever so the pulling tension of the spring/lever linkage rotates the rotatable lever and maintains tension on both chain linkages. Adjustable travel stops are provided. In an alternate embodiment, the return spring chain linkage is configured at right angles to the linear movement of the canister.

SUMMARY OF THE INVENTION

The invention is directed particularly to a rotary actuator comprising two parallel expandable tubes, each of which can be expanded along their respective axes from one end which is fixed to a frame. Each tube comprises a replaceable cartridge, and an attachment to the moving end of the cartridge, which slides on two diametrically, opposed glides.

The glides slide in slots in the frame to control and direct the axial movement of the expandable cartridge. Two chains are attached, one chain to each side of the attachment of one tube, looping a sprocket on a common shaft located on the frame adjacent to the fixed ends of the tubes and around the sprocket to attach to the respective sides of each attachment on the other tube. Pressurized fluid introduced into one tube expands the tube along its axis and away from the fixed end where the shaft is located. This action pulls both attached chains around their respective sprockets on the common shaft in a synchronous movement, thus turning the shaft, and at the same time retracting the other tube, which is not pressurized, towards the shaft. Releasing the pressure from the first tube, and pressurizing the second tube reverses the action.

The tube can be thick rubber accordion-shaped bellows. The tube can be a tube restricted from radial expansion by a fabric restrainer or wires or other suitable restraining mechanisms. The glides can be made of a substance such as Teflon™, or of an arrangement of bearings or similarly known means. The cartridge can be affixed to the frame end and to the moving attachment by slide in slots which parallel a diameter of the tube, or by buttons which insert into circular holes n the frame and moving attachment. The cartridge can be more tightly held in place during non-pressurized retraction by known means such as a set screw or a cotter pin.

The two chains of the actuator can be attached to a "D" or similar reinforced bar attached at 90 degrees to the rods of two conventional solid cylinder linear actuators (sometimes called "a cylinder"), thus creating rotary torque from conventional cylinders. In order to double the resultant torque, another pair of tubes can be located on the opposite side of the shaft, their chains looping two more sprockets which are adjacent to the first two sprockets. The result of such arrangement is that the forces on the shaft are equal and opposed, thus negating any side forces on the shaft bearings.

The invention is directed to an actuator comprising: (a) a first flexible hollow cylindrical fluid impermeable tube which can be expanded at one free end along a central axis of the cylinder when a fluid is introduced into the tube; and contracted along the same axis when fluid is withdrawn from the tube; (b) a second flexible hollow cylindrical fluid impermeable tube which can be expanded at one free end along a central axis of the cylinder when a fluid is introduced into the tube; and contracted along the same axis when fluid is withdrawn from the tube; (c) a first movable chain and sprocket mechanism associated with the first and second tubes, and located on a first side of the first and second tubes, the first tube pulling on the first chain when the first tube expands upon the introduction of fluid into the first tube and the second tube contracting upon the withdrawal of fluid from the second tube; (d) a second movable chain and sprocket mechanism connected to the first movable chain and sprocket mechanism by a shaft (f) and associated with the first and second tubes, and located on a second side of the first and second tubes, the first tube pulling on the second chain when the first tube expands upon the introduction of fluid into the first tube and the second tube contracting upon the withdrawal of fluid from the second tube; and (e) a rigid frame housing component (a), (b), (c), (d) and (f).

Expansion of the first and second tubes can be restricted to first and second parallel axes, and the frame can comprise a first component and a second component located on first and second sides of the first and second tubes and first and second chains. The free ends of the first and second tubes can have first and second attachments which slide in guides in the first and second components of the rigid frame.

First and second fixed connectors can be located on respective ends of the first and second tubes opposite from the free ends of the first and second tubes and can secure the fixed ends of the first and second tubes to the first and second components of the rigid frame.

First and second tubes can provide reciprocating action to the movable first chain and sprocket and the second chain and sprocket when fluid is alternatingly introduced into the first and second tubes. The first and second tubes can be made of elastomer, or of an internal elastomer and an exterior restrainer comprised of a collapsible fabric. The fluid can be compressed air or water.

The first and second chains and sprockets can be replaced by first and second cables which travel over first and second pulleys. The first and second attachments and the first and second connectors can be formed in two pieces which can be separated thereby enabling the first and second tubes to be removed from the interior of the frame without dismantling the frame.

The shaft connecting the first and second chains and sprockets can be connected to a motor, and the motor can drive the first and second tubes in reciprocating manner to cause the first and second tubes to alternatingly compress or pump fluid in the first and second tubes.

BRIEF DESCRIPTION OF DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
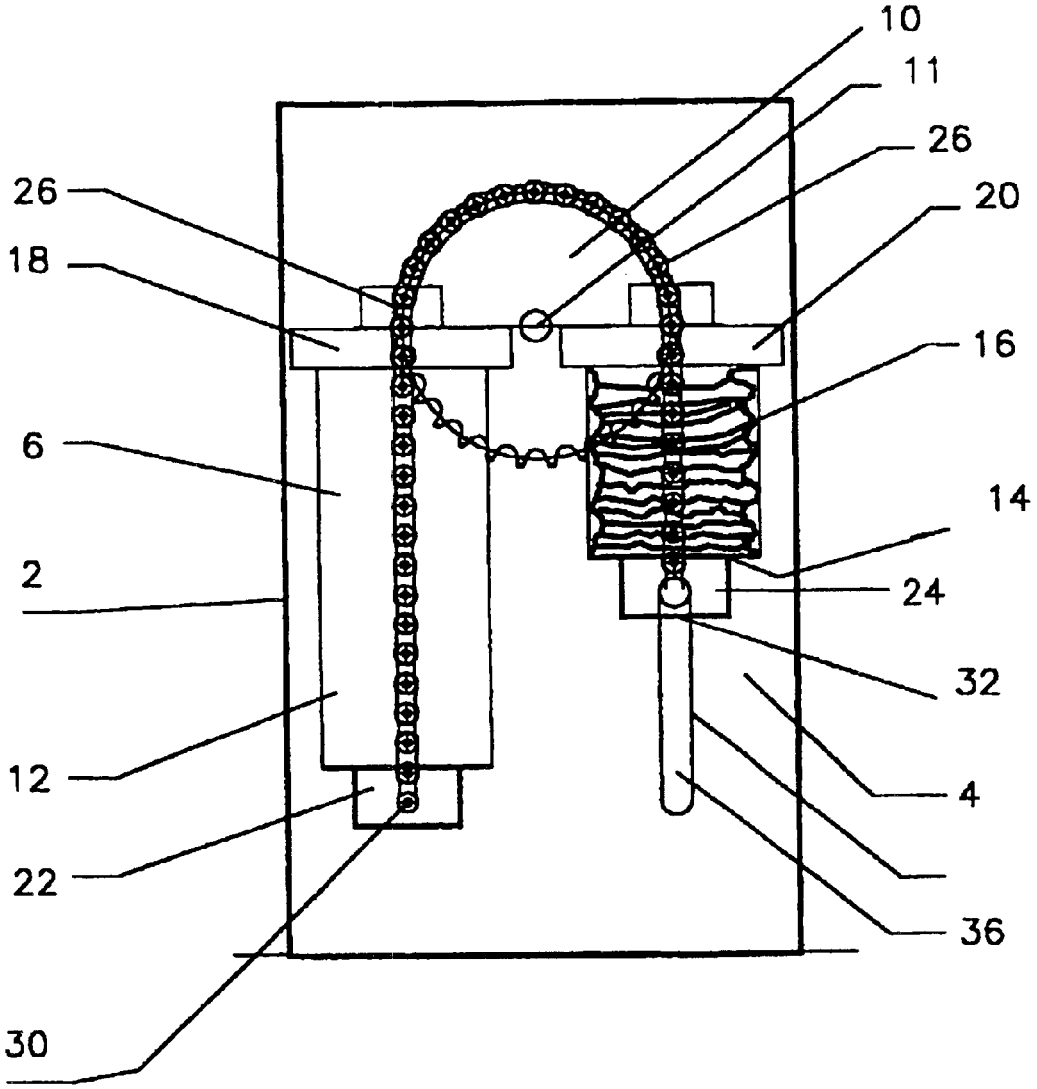
FIG. 1 illustrates an elevation of a double-action low pressure chain and cartridge actuator according to the invention.

The actuator according to the invention is directed to converting linear motion to rotary motion and at the same time avoiding the linear to rotary motion problems of the prior art. The actuator does not suffer from the side load problems experienced by conventional rack and pinion or scotch yoke methods of converting linear to rotary action. In layman's terms, it is easier to pull a wheel barrow or a long heavy pole, than it is to push it. This is because in pushing, the side forces when encountering friction, exacerbate the side load. In this example, for instance, the wheelbarrow or long heavy pole, on being pushed, tend to be forced into the ground, whereas when they are being pulled, they ride over the irregularities of the surface over which they are pulled. The actuator according to the invention capitalizes on this principle and utilizes chains which are pulled about a sprocket.

A second significant advantage of the invention over prior art is that the actuator has only one elastic component, namely two pressure tubes, either or both of which can be replaced quickly in the event of failure. While there are many variants of expandable pressure tubes disclosed in the art, conventional experience suggests that if fatigue failure occurs, it will typically be at the elastic components. With conventional rack and pinion, and solid tube actuators, the actuators are usually replaced in their entirety rather than being repaired. This is due to the complexity and time cost of repair. A replacement cartridge permits regular cyclical replacement of this part to avoid unanticipated failure.

The third advantage of the invention is that the chain drive is less complex than a rack and pinion or a scotch yoke method of translating linear motion to torque, thereby reducing manufacturing cost. Chain and sprocket drives are well known for their efficiency, economy and reliability. The chain and sprocket drive is superior to a rod which is pushed out from a conventional hydraulic or pneumatic cylinder. A rod is not amenable to pulling rather than pushing forces.

The rotary actuator according to one embodiment of the invention is constructed of a pair of hollow tubes connected by a pair of chains travelling around a pair of sprockets which are located on a common shaft. The two hollow tubes each work on the principle of an envelope which is expandable in one direction (linearly) but not the other (radially). In this embodiment of the invention, each tube is affixed at each end to respective members of a diameter equal to the diameter of the elastomer tube. One member on each tube is fixed while the other member on each tube is free to slide axially away from the fixed member on guides, which travel in slots on end plates.

In another embodiment of the invention, the tubes are constructed of an elastomer tube inside a restraining tube which is constructed of a material which has tensile strength but not compressive strength, such as a woven fabric. The restraining tube will not stretch at working pressures but will bend or collapse when pressure is relieved. The restraining tube is of a sufficient length that when it is fully extended under internal pressure, the fixed member and the moveable member are located at their maximum distance from each other. As internal pressure is relieved, the free sliding member moves toward the fixed member, and the restraining tube collapses and crumples. Both the inner elastomer tube and the exterior restraining tube are fixed at each end to the two end members in an air tight manner by known means such as clamps, or the like.

The fixed end member has an orifice through which pneumatic (or low pressure hydraulic) fluid is transmitted in a controlled manner by known means, such as a compressor or pump. The pressure created by the fluid directed into the interior of the elastomer tube causes the elastomer tube to expand. Since its radial expansion is constrained by the exterior restraining tube, all the generated force is directed axially in the direction of moving the free sliding member away from the fixed member.

The low pressure actuator, according to the invention, is directed to solving a major problem of the prior art, that is, avoiding stretching that is inherent with bellows type or piston-tube type actuators. This is done by having the restraining tube at rest when fully extended, and having the tube crinkle or fold when not extended. In that way, a material which is prone to bulging at high pressures when stretched is not used. A fabric or some other type of flexible radially restraining outer tube is suitable for this purpose.

If a woven fabric outer tube is used, the inner elastomer tube need not be as thick as with conventional bellows. It can be a very thin rubber, as it is fully constrained and supported by the fabric. The inner tube need only be fluid proof and thick enough so as not to bulge between the threads of the outer fabric and wear prematurely. Using a thin rubber tube also has the advantage that it stretches readily and reduces the energy loss that is experienced when thick rubber is stretched. In the invention, the rubber need not have great strength because the only purpose of the rubber is to contain the pressurizing fluid.

During the stroke of the actuator piston from the rest position, where the fabric is collapsed or deformed, to the extended position where the tube is fully inflated and stretched, there is no significant friction wear between the rubber and the fabric. This is because the rubber initially expands in the area of least resistance, that is, where the rubber is not in contact with the fabric. Consequently, there is no significant wear inducing rubbing between rubber and fabric when fully pressurized.

A detailed discussion about a specific embodiment of the invention will now be made with reference to the drawings. Referring to FIG. 1, which illustrates an elevation view of the low pressure double action chain and cartridge actuator, and FIG. 2, which illustrates a side view, the actuator 2 includes a pair of linear rigid side plates 4 and 5 (see FIG. 2). In between the two side plates 4 and 5, there is located a parallel but opposing pair of flexible bellows exterior fabric guide tubes 6 and 16 each of which encloses a stretchable flexible fluid impermeable inner tube (not shown in FIG. 1 or FIG. 2) made of a rubber or elastomer. The exterior fabric guide tubes 6 and 16 are extendable and contractible in a vertical linear direction but are not extendable in an outward radial direction.

The two bottom ends of the two tubes 6 and 16 are free to move up or down in a vertical direction while the opposite two top ends are fixed. As seen in FIG. 1, the upper opposite exterior ends of the two exterior guide tubes 6 and 16 are respectively connected to fixed top end members 18 and 20 which are secured in position to the actuator side plates 4 and 5. The opposite bottom ends 12 and 14 of the two fabric guide tubes 6 and 16 are attached to interior movable bottom end members 22 and 24 respectively on either side of central sprocket 10 and respectively have protrusions 30 and 32 and 38 and 40, which are free to move up or down in respective guide slots 34 and 36 (slot 34 is not visible in FIG. 1 but see FIG. 3). While not shown in the drawings, the tubes 6 and 16 can be secured to top fixed members 18 and 20 and bottom free members 22 and 28 by exterior clamps which can be removable.

FIG. 1 also illustrates one of the sprockets 10 which is rotationally connected horizontally between the two side plates 4 and 5 by shaft 11. Chain 26 is connected respectively to lower vertically movable end members 22 and 24. Chain 26 travels around the toothed circumference of first sprocket 10. Another chain (not visible in FIG. 1) is similarly connected to end members on the other side of the tubes and travels around second sprocket 10.

When air or a hydraulic fluid is injected through an inlet (not shown) into one of the inner tubes, for example, through end plate 18, on the left tube 6 in FIG. 1, the pressure of the air or fluid causes the tube 6 to expand in the only direction it can, namely, vertically downwardly from a sprocket 10. The chain 26 connected to the first movable end member 22 moves downwardly and causes the sprocket 10 and the shaft 11 to rotate in a counterclockwise direction. Meanwhile, the free end member 24 on the other fabric tube 16 on the right is pulled upwardly by chain 26 which causes the tube 16, which does not have positive air or hydraulic pressure in it, to wrinkle and collapse.

The opposite clockwise rotation action occurs when the left inner tube and exterior guide tube 6 are deflated and the right inner tube and exterior guide tube 16 are inflated with positive air or hydraulic pressure. Movable end member 24 moves downwardly, which pulls on chain 26, which in turn, via sprocket 10, pulls end member 22 upwardly. This action repeats itself and thus reciprocating action provides a double-action actuator.

Figure 2:
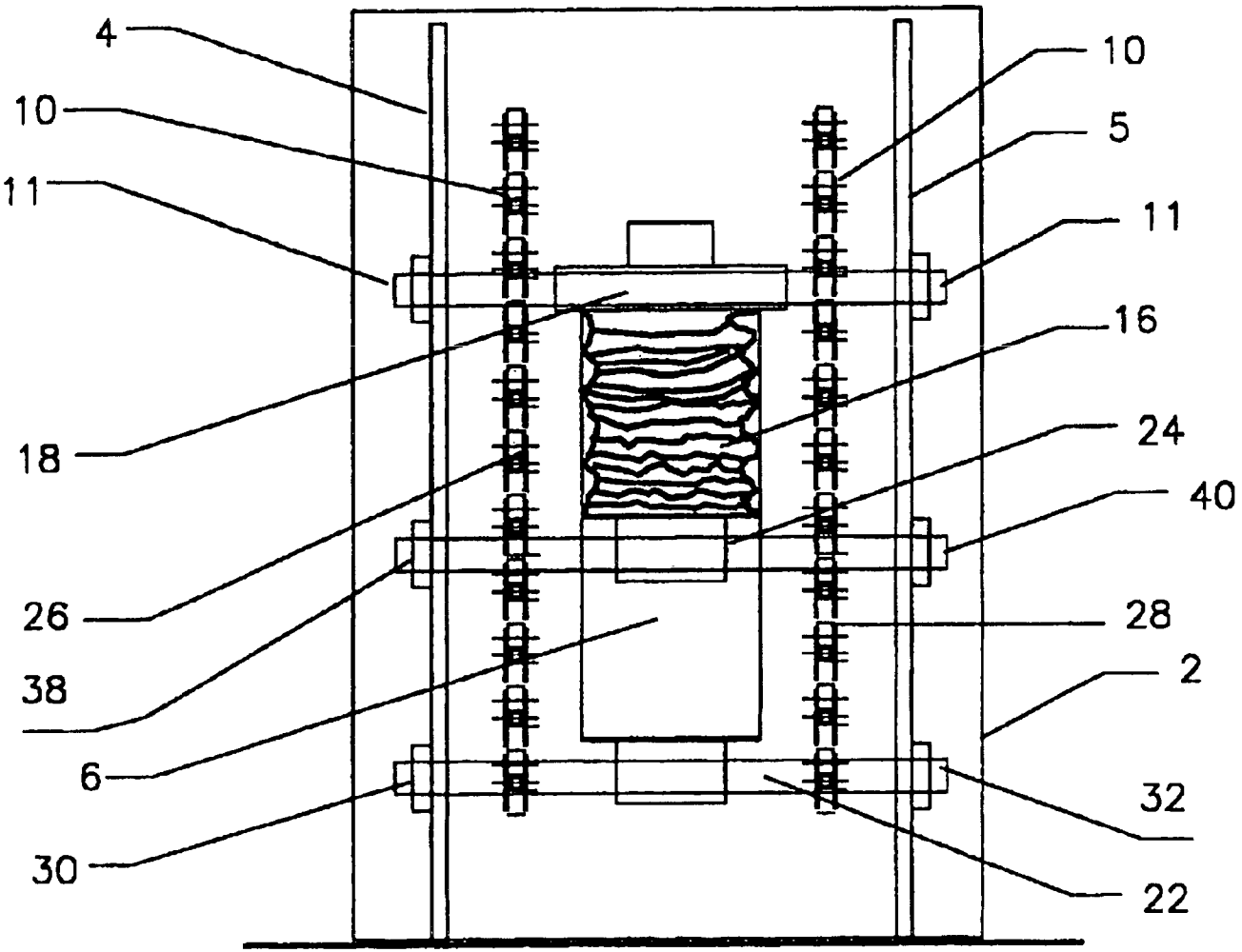
FIG. 2 illustrates a side view of the double-action low pressure chain and cartridge actuator.

FIG. 2 illustrates a side view of the actuator 2 including side plates 4 and 5, exterior first fabric guide tube 6, second guide, first fixed top end member 18, first free end bottom member 22, first and second chains 26 and 28, first and second sprockets 10 and connecting shaft 11. As seen in FIG. 2, first movable end member 22 has oppositely extending guide protrusions 30 and 32, which extend into and slide in respective vertical guide slots 34 in side plates 4 and 5 (see FIG. 3 for more detail). Likewise, second bottom member 24 has similar protrusions 38 and 40 which travel vertically in slots 36 of side plates 4 and 5.

Figure 3:
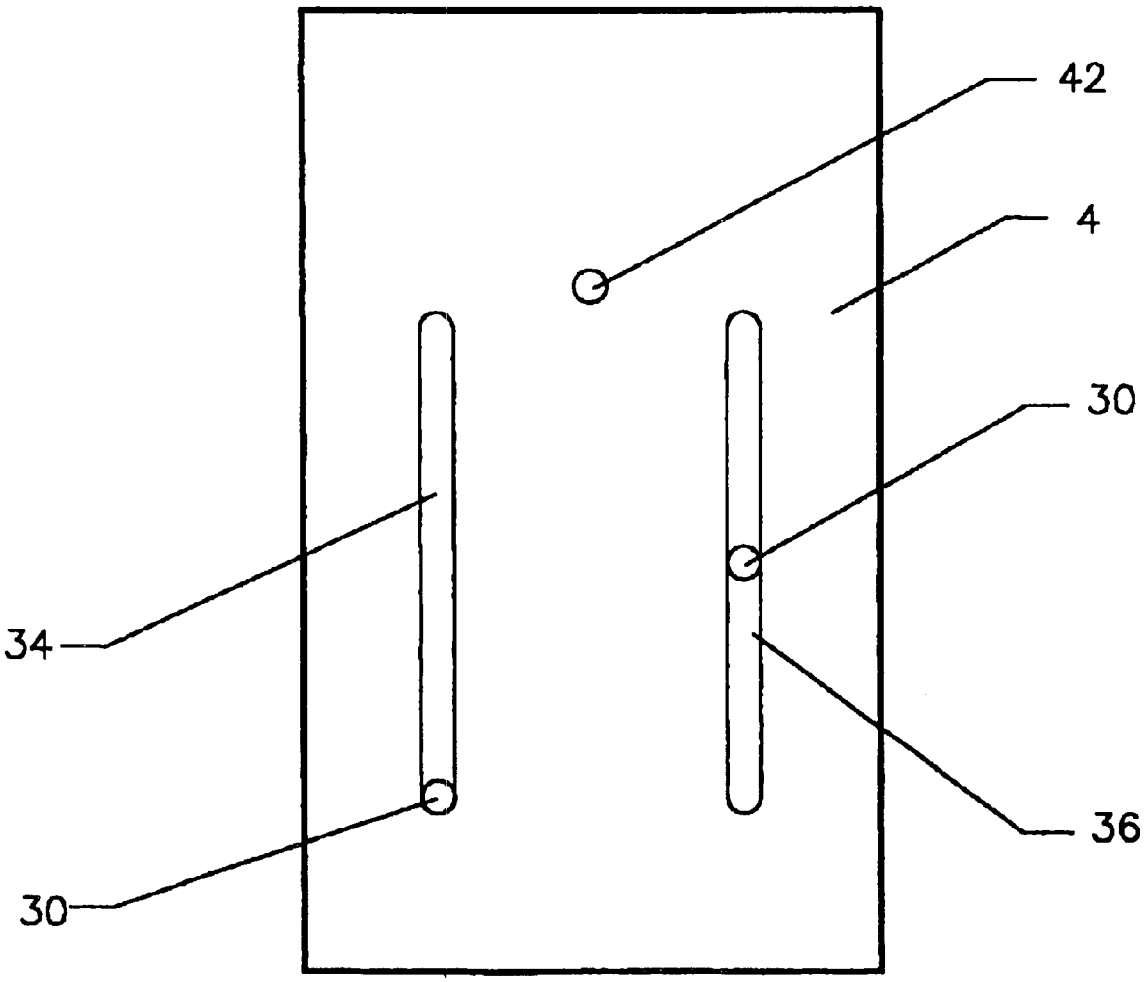
FIG. 3 is a front view of one of the side plates, showing slots for the guides of the actuator.

FIG. 3 illustrates a front view of side plate 4. As seen in FIG. 3, the side plate 4 is rectangular and has formed therein a pair of parallel vertical guide slots 34 and 36. Protrusion 30 of the first bottom end member 22 protrudes through slot 34 and is guided vertically up or down by slot 34 as tube 6 reciprocates up and down. A corresponding set of protrusions 38 and 40 extend from second movable bottom end member 24 and slide in guided fashion vertically up and down in second guide slot 36 and a corresponding slot in second side plate 5. It is understood that side plate 5 is constructed in a manner similar to side plate 4 with corresponding and parallel vertical guide slots. FIG. 3 also illustrates the circular opening 42 in which one end of shaft 11 fits. The shaft 11 is normally mounted in a bearing positioned in opening 42. Second side plate 5 has a similar circular opening for receiving the opposite end of shaft 11.

The inner tubes in the two tubes 6 and 16 are made of air or oil impermeable rubber or a similar fluid impermeable flexible elastomeric product. With the radial constraint created by the two exterior fabric tubes 6 and 16, the two inner tubes can expand only in an axial direction and cannot expand radially. The exterior fabric tubes 6 and 16 are attached to the respective inner tubes at each end. While an inner tube is in full tension, such as when it is fully inflated (the elastomer is stretched), the constraining exterior fabric tube 6 or 16, as the case may be, is also at full length. When the specific inner tube is shortened upon deflation, the constraining exterior fabric tube 6 or 16, as the case may be, folds or buckles in a random manner (see second fabric tube 16 in FIGS. 1 and 2).

The fixed top end members 18 and 20 may be solid metal or plastic disks located at the top ends of exterior fabric tubes 6 and 16, while the second set of bottom members 22 and 24 is located at the lower ends of exterior fabric tubes 6 and 16. As explained previously, the top disk or member 18 is securely fixed to the side plates 4 and 5. The member 18 has an entry port (not shown) to which is attached a fitting for a pneumatic or hydraulic fluid supply into the inner tube in fabric tube 6. The disk or member 22 at the bottom end of the exterior fabric tube 6 is movable and slides up and down in slot 34. The members 18 and 20 that are attached to the two exterior fabric tubes 6 and 16 can be secured by clamps or other known means which are removable. When compressed air is supplied through the fitting in the fixed member 18, the inner tube of fabric tube 6 is inflated and stretches downwardly. At the same time, the exterior fabric tube 6 lengthens and loses its folds, creases or buckles while at the same time restraining radial stretching of the inner tube. Thus all force due to inflation is applied downwardly in a linear manner. In turn, the bottom member 22 is forced downwardly and, sliding in vertical guide slot 34, pulls on chain 26 (and corresponding second chain 28, not visible in FIG. 1) and causes the pair of sprockets 10 to rotate on shaft 11. Meanwhile, opposite exterior tube 16 is depressurized and collapses in an upwardly direction as bottom member 24 slides upwardly in slot 36.

Figure 4:
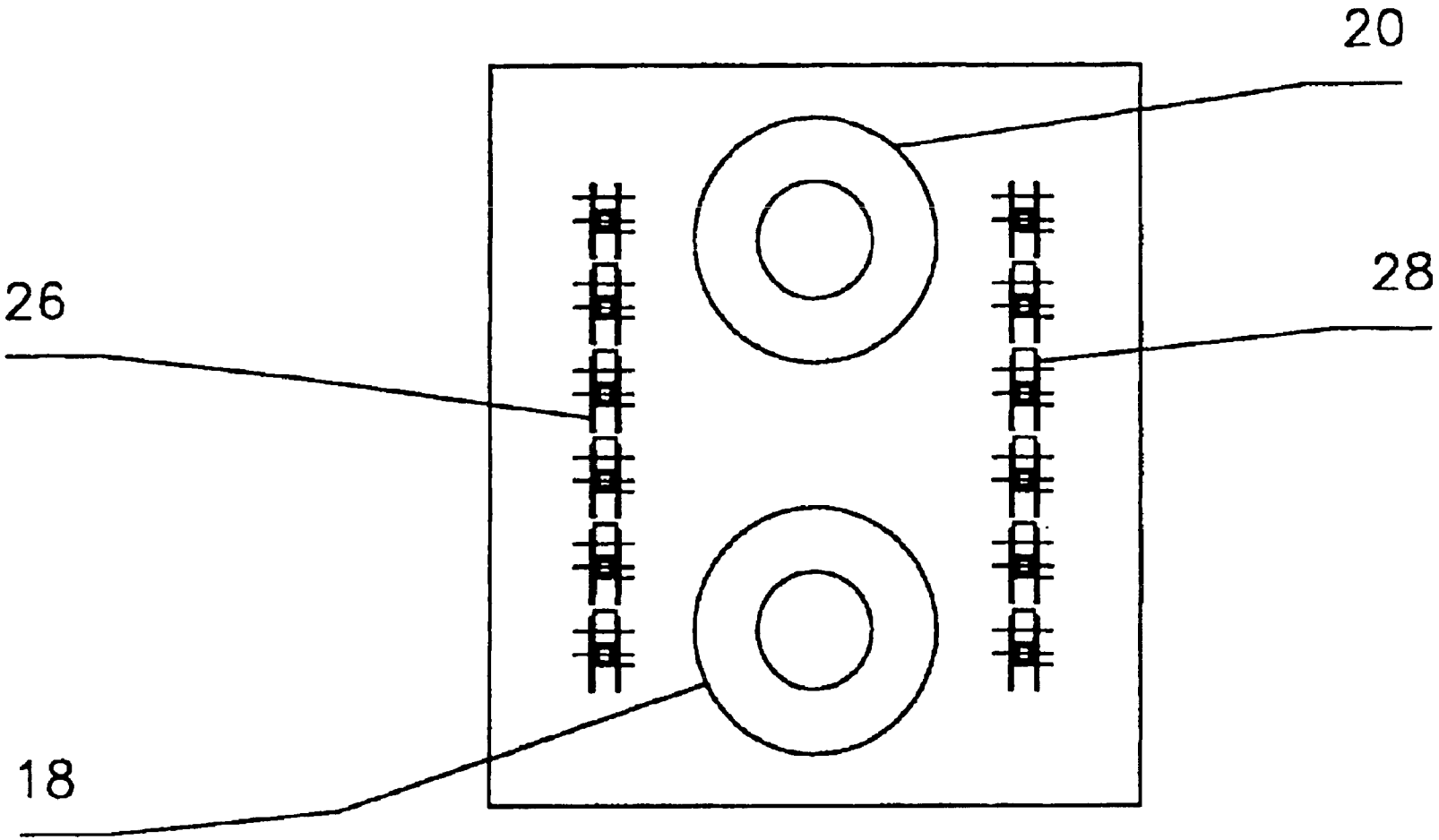
FIG. 4 is a plan view of the principal components of the double-action low pressure and cartridge actuator.

FIG. 4 illustrates a top simplified section view of the first and second top members 18 and 20, and the first and second chains 26 and 28. The first and second chains 26 and 28 travel about the pair of sprockets 10 which are not visible in FIG. 4.

Figure 5:
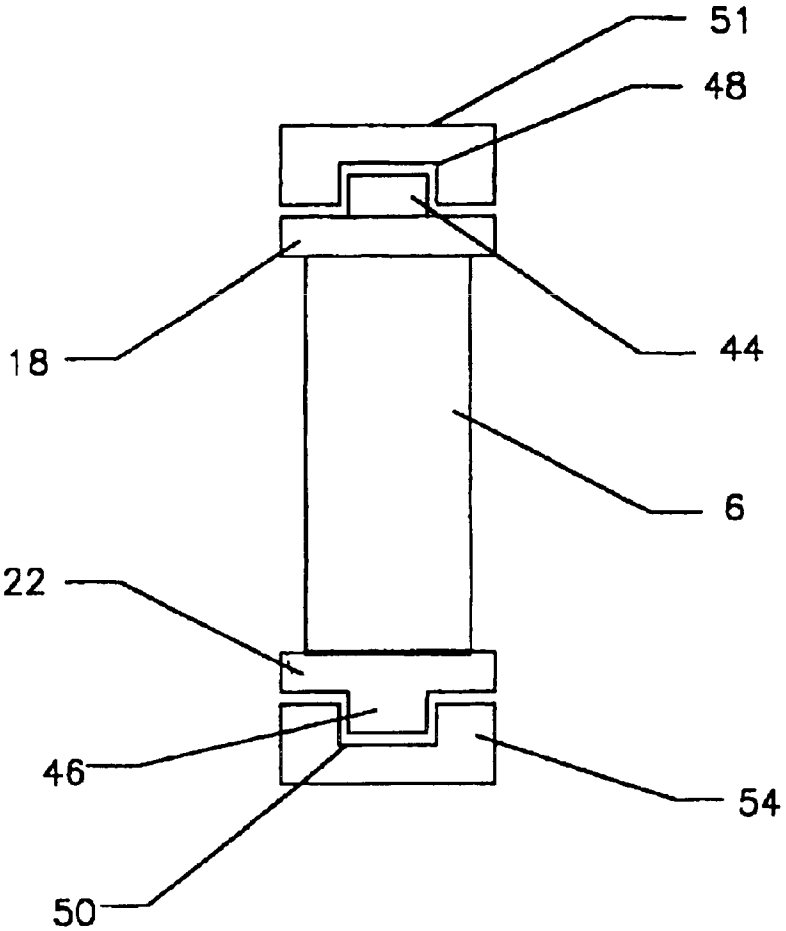
FIG. 5 illustrates a side view of a removable tube cartridge.

FIG. 5 illustrates a second embodiment of the invention whereby the fabric tube 6, top end member 18 and bottom end member 22 are each formed to have protrusions 44 and 46 which removably fit in openings 48 and 50 of a pair of end plates 51 and 54. This combination serves the same function as end members 18 and 22 of FIG. 1. The advantage of the design shown in FIG. 5 is that the tube 6 and members 18 and 22 form an individual cartridge which can be readily removed and replaced with a fresh cartridge, if something goes wrong with the tube 6 and associated fixtures in the first cartridge, such as a leak. In the embodiment illustrated in FIGS. 1 to 4, the entire actuator 2 must be taken apart if one of the fabric tubes 6 or 16 fails, such as with a puncture in the inner tube.

Figure 6:
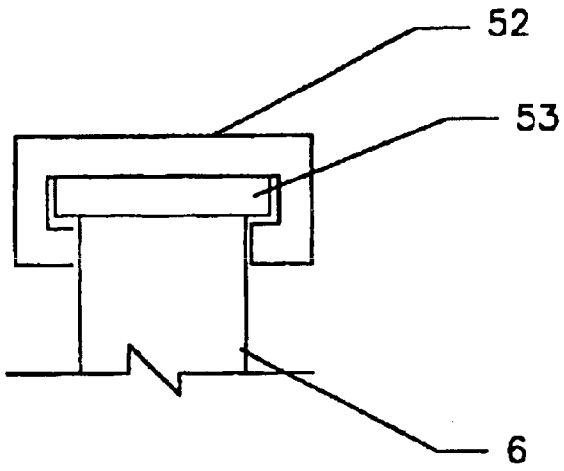
FIG. 6 illustrates a side view of an alternative embodiment of removable tube cartridge.

FIG. 6 illustrates a top end view of an alternative method of removably joining fabric tube 6 to the end plate 52. The upper end of tube 6 has a horizontal plate 53 which slidably fits in the opening in a horizontal "C"-shaped member 52.

Figure 7:
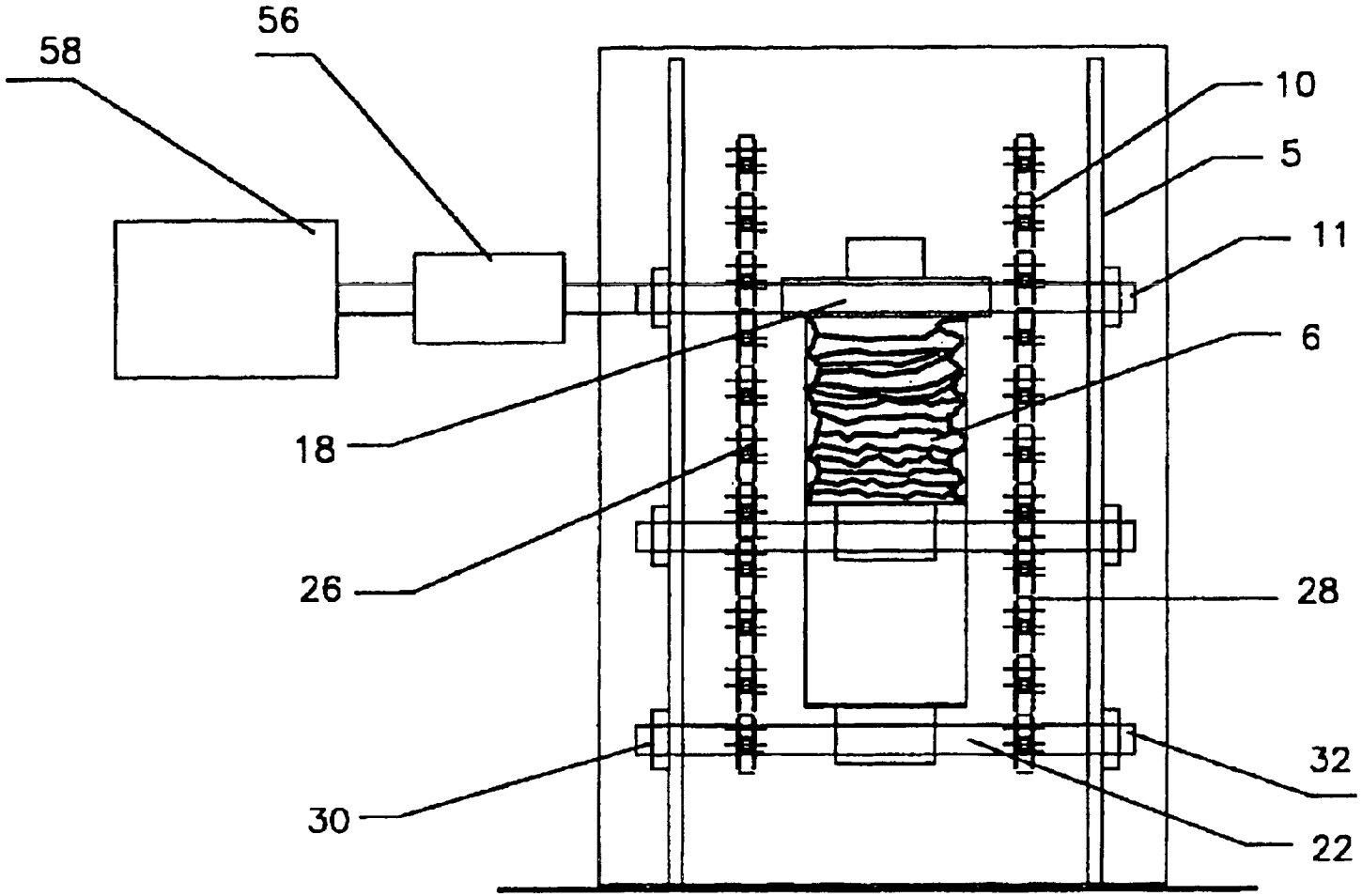
FIG. 7 illustrates an embodiment of the actuator wherein the actuator is driven by a motor to convert it to a compressor or pump.

FIG. 7 illustrates a third embodiment of the invention wherein the actuator is driven by a motor which converts the actuator to a pump or compressor. The basic elements of the actuator such as the pair of fabric tubes 6 and 16, the side plates 4 and 5, the top members 18 and 20, the bottom members 22 and 24, the pair of chains 26 and 28 and the pair of sprockets 10 are the same as described above in relation to FIGS. 1 to 4. However, the shaft 11 is connected to and is driven by a motor 58 through transmission 56. This converts the actuator to a pump or a compressor by drawing uncompressed ambient air into the expanding tube 6 and compressing and expelling it from the contracted tube 6.

Figure 8:
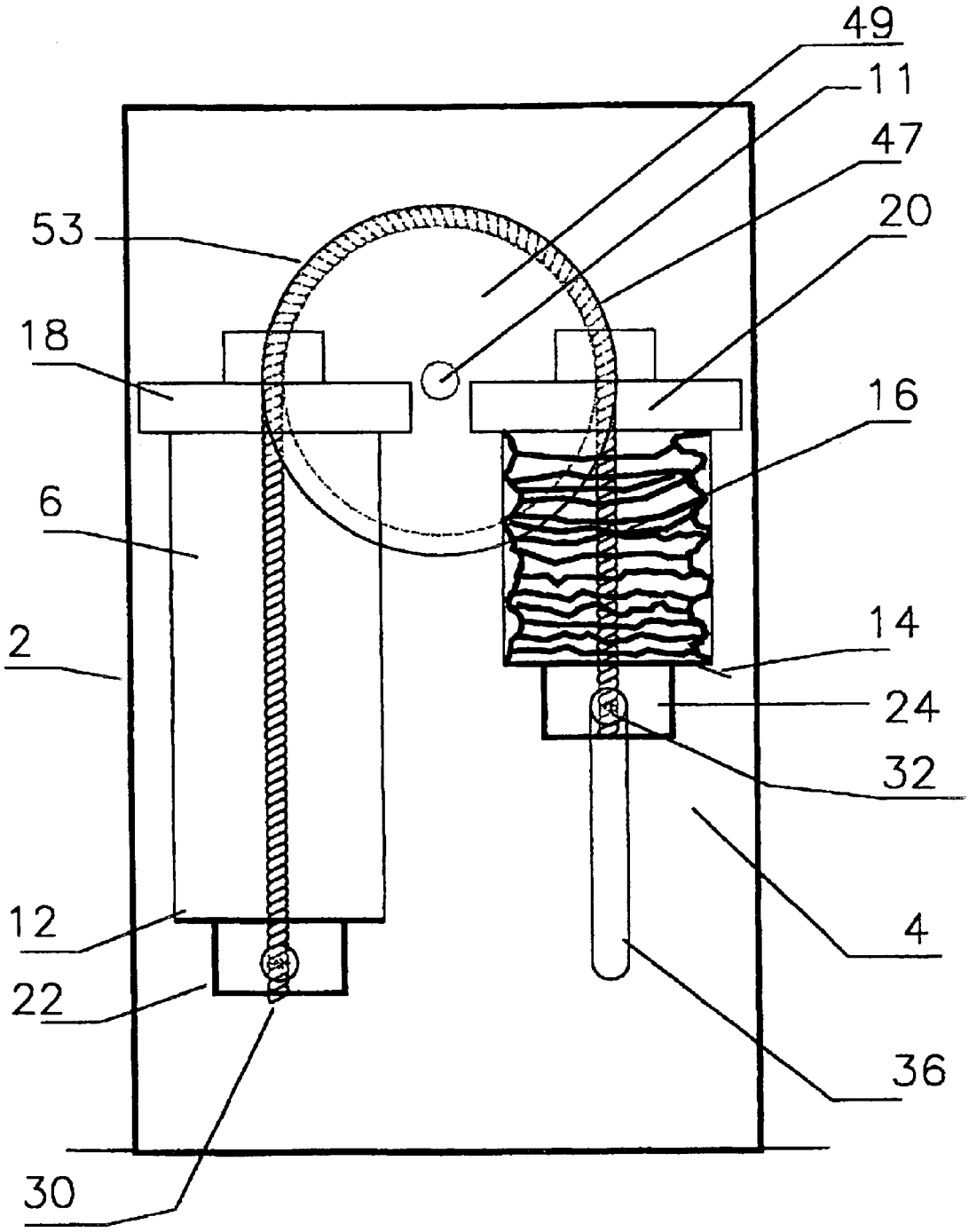
FIG. 8 illustrates an elevation of an embodiment of the actuator using a cable and pulley system.

FIG. 8 illustrates an elevation of an embodiment of the actuator wherein a steel strand cable and pulley combination are used in place of the chain and sprocket used in the other described embodiments. The cable 47 travels over the pulley 49. To prevent slippage of the cable 47 on the pulley 49, the cable is fixed at one point 53 to the pulley 49. This is not a problem because the pulley 49 does not rotate more than 180° from one side to the other.

The invention is particularly applicable to pneumatic actuators, which would be the most common use, but it should be understood that the invention has application in other areas as well, including hydraulics. The figures discussed above illustrate preferred embodiments of the invention. However, it will be understood that a number of variations can be made which nonetheless represent part of the overall invention. For example, by using a combination material for the outer tubes 6 and 16, such as a an elastomer or rubberized fabric, or other similar material, which is airtight or oil tight, and has fixed radial strength, the outer restraining tube 6 can serve two purposes, thereby eliminating the need for a separate fluid impermeable inner rubber or elastomer tube.

As a general rule, typical pneumatic actuators work in the range roughly of 80 to 100 psig internal pressure. Normal fabrics such as cotton and the attendant stitching are not suitable for the exterior tubing because the cotton will not withstand pressures of 80 to 100 psig without failing. However, suitable fabrics made from commercially available high strength textiles such as Nylon™, Mylar™, and the like, will withstand such pressures, and can be used in the subject invention.

Hydraulic actuators have been known to work up to about 6000 psig pressure, but typically, for safety reasons, they operate at only about 1500 psig. However, 1500 psig pressure is higher than the subject invention will withstand. Generally, hydraulics are not used at low pressure because they are uneconomical. However, an exception is in domestic tap water supply systems. An actuator according to the invention can operate using domestic water hookup if there are very few cycles per day. In this application, no air compressor or hydraulic pump is required and application of the actuator is practical if water consumption is small and only a few cycles a day are required.

Advantages, Modifications and Variations of the Actuator According to the Invention (1) The radial force created by fluid pressure is absorbed by the exterior fabric tube 6, so the resilient inner tube can be very thin as it only serves as an fluid or air seal. The radial force of the air or hydraulic pressure is contained by the exterior fabric tube 6.

(2) A one-way stretch fabric material of the exterior tube 6 can be embedded, built in or attached to the resilient inner tube 8 throughout the length rather than having it attached only at the ends.

(3) The exterior fabric tube 6 can be manufactured either from a flat fabric with a longitudinal seam to create a tubular shape, or from fabric woven as a tube. The fabric tube must have a fixed circumference and length but is collapsible both radially and lengthwise.

(4) The exterior fabric tube 6, by shape or content can be constructed in such a way as to guide the wrinkling effect in a bellows manner on deflation rather than allowing it to wrinkle or collapse in a random manner.

(5) Depending on the combination of materials used (fabric, rubber, etc.) there is sometimes a need for a fixed rigid guide frame of metal or plastic positioned outside the fabric. As seen in FIGS. 2 and 3, the guide frame is in the form of side plates 4 and 5 which are positioned exterior of the exterior tubes 6 and 16. This serves to control random deformation buckling of the tubes 6 and 16 and maintain vertical linear alignment. In the case of actuator use, this guide frame in the form of side plates 4 and 5 may have longitudinal slots to allow movement of the force components (movable end members 22 and 24) attached to the tubes 6 and 16. Other types of frames, other than plates 4 and 5, can be used.

(6) The actuator 2 can be activated by filling the inner tube with a suitable hydraulic fluid rather than pneumatically with gas or air.

(7) The elastomer inner tube, if advantageous, can be bonded to the exterior fabric tube 6.

(8) The actuator 2 can be combined with another acutator, if desired, to give more power.

(9) The actuator according to the invention is less expensive to manufacture than other conventional actuators because there is no requirement for air seals between moving parts. The actuator is simple in construction and there is less requirement for machining.

(10) The actuator of the invention is lighter in weight than current actuators because it has fewer parts. Also, there is no solid metal tube.

(11) The only moving parts of the actuator (excluding the exterior slides, chains and sprockets) are the elastomer inner tube and exterior fabric tube. Both these parts are inexpensive to buy and simple, easy and quick for a shop mechanic to replace with no specialized tools.

(12) There is low wear in the actuator because apart from the elastomer and fabric tubes, all other parts are exterior and create little environment for failure or wear.

(13) Contaminated air causes no problems in the operation of the actuator because there are no sliding air seals to become clogged or fouled.

(14) With the double-acting parallel vertical cylinders, the extent of tube travel can be approximately 75% of total length. This expandability is very useful in tight confined locations.

(15) The actuator can be connected to a motor and operated in reverse. In that way, the pair of tubes can be used to compress or pump fluids of various types.

(16) The chains and sprockets can be replaced with flexible cables, normally of twisted steel wire, and pulleys, the cables being affixed to the pulleys by any well known means.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An actuator constructed of: (a) a first flexible hollow cylindrical fluid impermeable tube (6) which can be expanded at one free end along a central axis of the cylinder when a fluid is introduced into the tube; and contracted along the same axis when fluid is withdrawn from the tube; and (b) a second flexible hollow cylindrical fluid impermeable tube (16) which can be expanded at one free end along a central axis of the cylinder when a fluid is introduced into the tube; and contracted along the same axis when fluid is withdrawn from the tube; characterized by:

(c) a first movable cable and pully mechanism with the cable affixed to the pully associated with the first and second tubes (6, 16), and located on a first side of the first and second tubes, the first tube pulling on one end of the cable when the first tube expands upon the introduction of fluid into the first tube and the second tube contracting upon the withdrawal of fluid from the second tube;

(d) a second movable cable and pulley mechanism with the cable affixed to the pulley connected by a shaft (11) to the first moveable cable and pulley mechanism and associated with the first and second tubes, and located on a second side of the first and second tubes, the first tube pulling on one and of the cable when the first tube expands upon the introduction of fluid into the first tube and the second tube contracting upon the withdrawal of fluid from the second tube; and (e) a rigid frame (2) housing the first and second flexible hollow cylindrical fluid impermeable tubes, and the first and second moveable cable and pulley mechanisms.

2. An actuator as claimed in claim 1 wherein expansion of the first and second tubes is restricted to first and second parallel axes, and the frame comprises a first component (4) and a second component (5) located on first and second sides of the first and second tubes and first and second cables.

3. An actuator as claimed in claim 2 wherein the free ends of the first and second tubes have first and second attachments which slide in guides in the first and second components of the rigid frame.

4. An actuator as claimed in claim 3 wherein first and second fixed connectors are located on respective ends of the first and second tubes opposite from the free ends of the first and second tubes and secure the fixed ends of the first and second tubes to the first and second components of the rigid frame.

5. An actuator as claimed in claim 1 wherein first and second tubes provide reciprocating action to the movable first cable and pulley and the second cable and pulley when fluid is alternatingly introduced into the first and second tubes.

6. An actuator as claimed in claim 1 wherein the first and second tubes are made of elastomer.

7. An actuator as claimed in claim 1 wherein the first and second tubes are made of an internal elastomer and an exterior restrainer comprised of a collapsible fabric.

8. An actuator as claimed in claim 1 wherein the fluid is compressed air or water.

9. An actuator as claimed in claim 4 wherein the first and second attachments and the first and second connectors are respectively formed in two pieces which can be separated from one another thereby enabling the first and second tubes to be removed from the interior of the frame without dismantling the frame or other components.

10. An actuator as claimed in claim 2 wherein the first and second cables and pulleys are connected by the shaft to a motor, and the motor drives the first and second tubes in reciprocating manner to cause the first and second tubes to alternatingly compress or pump fluid in the first and second tubes.

* * * * *